US007029554B2

(12) United States Patent
Goda

(10) Patent No.: US 7,029,554 B2
(45) Date of Patent: Apr. 18, 2006

(54) METHOD FOR BRIGHTENING PULP WITH HYDROSULFITE SOLUTION GENERATED FROM BOROHYDRIDE AND BISULFITE

(75) Inventor: Rangamannar Goda, Hampstead, NH (US)

(73) Assignee: Rohm and Haas Company, Philadelphia, PA (US)

( * ) Notice: Subject to any disclaimer, the term of this patent is extended or adjusted under 35 U.S.C. 154(b) by 270 days.

(21) Appl. No.: 10/465,433

(22) Filed: Jun. 19, 2003

(65) Prior Publication Data

US 2004/0000380 A1 Jan. 1, 2004

Related U.S. Application Data

(60) Provisional application No. 60/392,745, filed on Jun. 28, 2002.

(51) Int. Cl.
*D21C 9/10* (2006.01)
*D21H 11/08* (2006.01)

(52) U.S. Cl. ..... 162/80; 162/24; 162/83; 162/90

(58) Field of Classification Search ..... 162/24, 162/80, 83, 90
See application file for complete search history.

(56) References Cited

U.S. PATENT DOCUMENTS

| | | | | |
|---|---|---|---|---|
| 2,071,304 A | | 2/1937 | Hirschkind | |
| 3,856,696 A | | 12/1974 | Stanbank et al. | 252/188 |
| 4,788,041 A | | 11/1988 | Sanglet | 422/234 |
| 4,919,755 A | * | 4/1990 | Mansson | 162/83 |
| 5,094,833 A | | 3/1992 | Ko et al. | 423/515 |
| 5,169,555 A | | 12/1992 | Mikulski et al. | 252/188.26 |
| 5,336,479 A | | 8/1994 | Munroe | 423/515 |

FOREIGN PATENT DOCUMENTS

| | | |
|---|---|---|
| DE | 3809332 A | 10/1989 |
| EP | 0155928 A | 9/1985 |
| EP | 0577396 A | 1/1994 |
| EP | 0604088 A | 6/1994 |

* cited by examiner

*Primary Examiner*—Steven P. Griffin
*Assistant Examiner*—Anna L. Kinney
(74) *Attorney, Agent, or Firm*—Kenneth Crimaldi

(57) ABSTRACT

A method for brightening pulp at a pH from 4.5 to 9. The method comprises the steps of: (a) combining an alkali metal borohydride, an alkali metal hydroxide, an alkali metal bisulfite and phosphoric acid to form a reducing solution; and (b) adding the reducing solution to a pulp slurry in an amount from 0.1% to 4% of hydrosulfite based on dry pulp fiber.

11 Claims, No Drawings

METHOD FOR BRIGHTENING PULP WITH HYDROSULFITE SOLUTION GENERATED FROM BOROHYDRIDE AND BISULFITE

CROSS REFERENCE TO RELATED PATENT APPLICATIONS

This is a non-provisional application of prior pending U.S. provisional application Ser. No. 60/392,745 filed Jun. 28, 2002.

BACKGROUND

This invention relates generally to a method for producing a hydrosulfite solution useful for brightening pulp.

Hydrosulfite can be generated by reacting aqueous sodium bisulfite solution with aqueous sodium borohydride solution. For example, U.S. Pat. No. 4,788,041 describes generation of hydrosulfite from a borohydride/hydroxide solution and a bisulfite solution. Sulfuric acid has been used to adjust the pH of the reaction mixture to an approximately neutral range. However, the sulfate salts generated from sulfuric acid do not have any utility in the papermaking process for which hydrosulfite usually is generated.

The problem addressed by this invention is to find a more effective method for brightening pulp using hydrosulfite.

STATEMENT OF INVENTION

The present invention is directed to a method for brightening pulp at a pH from 4.5 to 9. The method comprises the steps of: (a) combining an alkali metal borohydride, an alkali metal hydroxide, an alkali metal bisulfite and phosphoric acid to form a reducing solution; and (b) adding the reducing solution to a pulp slurry in an amount from 0.1% to 4% of hydrosulfite based on dry pulp fiber.

DETAILED DESCRIPTION

The method of the present invention is useful for brightening pulp, preferably either mechanical pulp or recycled pulp. Preferably, the method is performed on a pulp slurry in which the pH is at least 4.5, more preferably at least 5, and most preferably at least 5.2. Preferably, the pulp slurry has a pH no greater than 9, more preferably no greater than 7, and most preferably no greater than 6. Preferably, the pH remains within the preferred limits throughout the addition of the reducing agent. The consistency of the pulp slurry is not critical, but for example, it could be from 2% to 55%, but more preferably it is from 3.5% to 15%.

Dithionite ion, also referred to as hydrosulfite, can be produced by the reaction between bisulfite and borohydride ions, according to the following equation:

$$BH_4^- + 8\ HSO_3^- + H^+ \rightarrow 4\ S_2O_4^{-2} + B(OH)_3 + 5H_2O$$

The yield is somewhat less than 100% due to competing reactions, including that of borohydride with water, but is most often better than 85%. Since the exact mechanism of the reaction has not been fully characterized, this invention is not limited to reduction by dithionite ion, and other species present in the reaction mixture also may act as reducing agents. Preferably, the amount of bisulfite used is from about 8 to about 14 moles per mole of borohydride.

The source of the borohydride ion is sodium borohydride or potassium borohydride. Sodium borohydride is preferred. The source of bisulfite ion is the ammonium, sodium or potassium salt. The sodium salt is preferred. In one embodiment of the invention, bisulfite is generated by combining water and a metabisulfite, e.g., sodium metabisulfite, $Na_2S_2O_5$. The bisulfite material is an alkali metal bisulfite, preferably a form of sodium bisulfite, e.g., about 20% to about 45% active liquid by weight.

A preferred borohydride composition for use in accordance with the methods of the invention is in liquid form and comprises about 1% to about 36% active sodium borohydride and about 30 to about 40% NaOH or $Na_2CO_3$ (also known as soda ash), all by weight. A particularly preferred borohydride composition comprising 12% active sodium borohydride and 40% NaOH is commercially available from Rohm and Haas Company under the trademark Borol™ solution. (For example, 100 g of Borol™ solution contains 12 g sodium borohydride, 40 g NaOH, and 48 g $H_2O$).

Acid is added when borohydride reacts with bisulfite to adjust pH to optimize production of hydrosulfite. When hydrosulfite is generated from a sodium borohydride solution containing sodium hydroxide, e.g., Borol™ solution, and phosphoric acid is used to adjust pH, the equation is as follows $$[NaBH_4 + 3.2\ NaOH] + 8\ NaHSO_3 + 2.8\ H_3PO_4 \rightarrow 4\ Na_2S_2O_4 + 1.4\ NaH_2PO_4 + 1.4\ Na_2HPO_4 + B(OH)_3 + 8.2H_2O$$

Use of larger or smaller amounts of phosphoric acid will result in a change in the relative amounts of phosphate salts produced. Smaller amounts result in formation of trisodium phosphate, while larger amounts produce more sodium dihydrogen phosphate. The reducing solution produced from basic sodium borohydride solution and sodium bisulfite is known as Borol™-Generated-Hydrosulfite ("BGH").

Preferably, the amounts of reagents used to form the reducing agent, on a basis of 1 kg of sodium borohydride, are as follows. Preferably, the amount of alkali metal bisulfite is from 10 kg to 40 kg, more preferably from 10 kg to 30 kg, and most preferably from 15 kg to 25 kg. Preferably, the amount of alkali metal hydroxide is from 0.1 kg to 35 kg, more preferably from 0.5 kg to 20 kg, and most preferably from 1 kg to 10 kg. Preferably, the amount of phosphoric acid is from 0.1 kg to 75 kg, more preferably from 1 kg to 30 kg, and most preferably from 3 kg to 12 kg.

Preferably, the reaction of borohydride and bisulfite is performed at a temperature in the range from 4° C. to 50° C., preferably from 10° C. to 35° C. The pH of the reaction mixture preferably is from 4 to 14, more preferably from 5 to 12, and most preferably from 6 to 10. Preferably, the reaction to form BGH is continued until formation of hydrosulfite is substantially complete, i.e., there is no further significant increase in hydrosulfite concentration. Typically, the time for substantial completion varies from 0.1 sec to 2 min, preferably 1–2 min, although times as long as 72 hours are possible. BGH solution can be stored for much longer periods of time before use, especially with addition of base to increase the pH. When the pH of the final mixture is greater than 8, storage for as long as 2 weeks is possible.

Preferably, the amount of reducing agent added to the pulp slurry, measured as the percentage of hydrosulfite relative to the dried fiber content of the pulp, is from 0.1% to 4%, more preferably from 0.2% to 3%, and most preferably from 0.25% to 2%. Preferably, the temperature of the pulp slurry during the addition of reducing agent is from 20° C. to 120° C., more preferably from 40° C. to 100° C., and most preferably from 45° C. to 70° C. The time for the bleaching process preferably is from 15 min to 20 hrs, more preferably from 30 min to 90 min, and most preferably from 40 to 70 min.

EXAMPLES

Example 1

Bleaching of Mechanical Pulp with BGH Generated with Sulfuric or Phosphoric Acid The pulp used in this example was a thermomechanical pulp (TMP). Studies were conducted to determine the effect on BGH bleached pulp brightness levels of the use of either sulfuric or phosphoric acid in generation of BGH from borohydride. Hydrosulfite was generated from Borol™ solution, sodium bisulfite, and either sulfuric or phosphoric acid. Polyethylene bags were charged with pulp slurry containing 7 g pulp (weight on an oven-dried basis). The bags were preheated in a constant temperature bath at 50–70° C. for 15 minutes. The hydrosulfite dosage (BGH) was 0–25 lbs./ton of pulp, based on titration of the BGH solution for hydrosulfite, and the initial BGH pH was 6.5 for both sulfuric and phosphoric acid BGH. Temperature was 60° C., retention time was 45 minutes, consistency of pulp in the pulp slurry was 3.5%, and the initial pH of the pulp slurry was 5.3. The initial brightness of the pulp slurry was 56.2%. The raw data for these experiments can be seen in Table 1. Final pH and brightness, as a percentage ISO, are listed for each BGH value for both sulfuric acid and phosphoric acid.

TABLE 1

| BGH | final pH, sulfuric acid | brightness, sulfuric acid | final pH, phosphoric acid | brightness, phosphoric acid |
|---|---|---|---|---|
| 0.0 | 5.3 | 56.2 | 5.3 | 56.2 |
| 5.0 | 5.1 | 59.3 | 5.3 | 59.9 |
| 15.0 | 5.0 | 62.0 | 5.3 | 62.8 |
| 25.0 | 5.0 | 62.8 | 5.4 | 63.8 |

Example 2

Bleaching of Mechanical Pulp with BGH Generated with Sulfuric or Phosphoric Acid with Addition of Caustic to BGH The procedure of Example 1 was followed, but with addition of sodium hydroxide to the BGH to adjust its pH to 9.0 for both sulfuric acid and phosphoric acid BGH. The results are reported in Table 2.

TABLE 2

| BGH | final pH, sulfuric acid | brightness, sulfuric acid | final pH, phosphoric acid | brightness, phosphoric acid |
|---|---|---|---|---|
| 0.0 | 5.3 | 56.2 | 5.3 | 56.2 |
| 5.0 | 5.3 | 58.6 | 5.6 | 59.5 |
| 10.0 | 5.4 | 60.5 | 5.9 | 60.9 |
| 15.0 | 5.5 | 61.4 | 6.1 | 62.1 |
| 20.0 | 5.7 | 61.9 | 6.2 | 62.6 |
| 25.0 | 5.8 | 62.2 | 6.3 | 63.0 |

Example 3

Bleaching of Recycled Pulp with BGH Generated with Sulfuric or Phosphoric Acid The procedure of Example 1 was followed, but with use of recycled pulp. Temperature was 50° C., retention time was 60 minutes, consistency of pulp in the pulp slurry was 4.5%, and the initial pH of the pulp slurry was 6.6. The initial BGH pH was 6.5 for both sulfuric and phosphoric acid BGH. The initial brightness of the pulp slurry was 57.8%. The results for sulfuric acid BGH and phosphoric acid BGH are reported in Tables 3 and 4, respectively. BGH amounts are reported in kg/ton of pulp. Effective Residual Ink Concentrations in ppm (ERIC), as well as L*, a* and b* values are reported.

TABLE 3

(sulfuric acid BGH)

| BGH | final pH | brightness, % ISO | ERIC | L* | a* | b* |
|---|---|---|---|---|---|---|
| 0.0 | 6.6 | 58.2 | 203.5 | 85.3 | −0.4 | 7.0 |
| 1.0 | 6.6 | 59.8 | 205.4 | 85.3 | −1.2 | 6.8 |
| 2.0 | 6.6 | 60.0 | 217.5 | 85.6 | −1.3 | 6.7 |
| 3.0 | 6.5 | 60.3 | 206.3 | 85.5 | −1.3 | 6.8 |
| 4.0 | 6.5 | 60.3 | 207.3 | 85.5 | −1.4 | 6.8 |
| 5.0 | 6.5 | 60.3 | 211.0 | 85.4 | −1.4 | 6.8 |

TABLE 4

(phosphoric acid BGH)

| BGH | final pH | brightness, % ISO | ERIC | L* | a* | b* |
|---|---|---|---|---|---|---|
| 0.0 | 6.6 | 58.2 | 203.5 | 84.6 | −0.4 | 7.0 |
| 1.0 | 6.6 | 60.2 | 209.9 | 85.4 | −1.2 | 6.6 |
| 2.0 | 6.6 | 60.7 | 204.6 | 85.7 | −1.4 | 6.7 |
| 3.0 | 6.5 | 61.0 | 201.7 | 85.9 | −1.4 | 6.6 |
| 4.0 | 6.5 | 61.4 | 210.4 | 86.0 | −1.4 | 6.6 |
| 5.0 | 6.5 | 61.5 | 202.2 | 86.0 | −1.4 | 6.5 |

The results presented in Tables 1–4 demonstrate the unexpected benefit of using phosphoric acid for generation of hydrosulfite reducing solutions. The brightness of pulp treated with phosphoric acid BGH solution consistently is higher than that of pulp treated with sulfuric acid BGH solution.

The invention claimed is:

1. A method for brightening pulp at a pH from 4.5 to 9; said method comprising steps of:

(a) combining an alkali metal borohydride, an alkali metal hydroxide, an alkali metal bisulfite and phosphoric acid to form a reducing solution which comprises hydrosulfite; and (b) adding the reducing solution to a pulp slurry in an amount from 0.1% to 4% of hydrosulfite based on dry pulp fiber;

wherein the alkali metal hydroxide is added in an amount from 1 kg to 10 kg, the alkali metal bisulfite is added in an amount from 10 kg to 30 kg, and phosphoric acid is added in an amount from 1 kg to 30 kg, all on a basis of 1 kg of alkali metal borohydride.

2. The method of claim 1 in which the alkali metal borohydride is sodium borohydride, the alkali metal bisulfite is sodium bisulfite and the alkali metal hydroxide is sodium hydroxide.

3. The method of claim 2 in which the reducing solution is formed at a pH from 4 to 14.

4. The method of claim 3 in which the pulp is mechanical pulp.

5. The method of claim 4 in which the reducing solution is formed at a pH from 6 to 7.

6. The method of claim 5 in which initial pH of the mechanical pulp slurry is from 4.5 to 6.

7. The method of claim 6 in which the pH of the pulp slurry during addition of the reducing solution is from 5 to 7.

8. The method of claim 3 in which sodium bisulfite is added in an amount from 15 kg to 25 kg, and phosphoric acid is added in an amount from 3 kg to 12 kg, all on a basis of 1 kg of sodium borohydride.

9. The method of claim 8 in which the pulp is mechanical pulp.

10. The method of claim 9 in which the reducing solution is formed at a pH from 6 to 7.

11. The method of claim 10 in which initial pH of the mechanical pulp slurry is from 4.5 to 6.

* * * * *